US008307496B2

(12) United States Patent
Wu

(10) Patent No.: US 8,307,496 B2
(45) Date of Patent: Nov. 13, 2012

(54) AIR PRESSURE INNER CIRCULATION-TYPE AUTOMATIC COMPENSATION CONTROL DOOR CLOSER

(75) Inventor: Fengqing Wu, Zengcheng (CN)

(73) Assignee: CMECH (Guangzhou) Industrial Ltd. (CN)

( * ) Notice: Subject to any disclaimer, the term of this patent is extended or adjusted under 35 U.S.C. 154(b) by 418 days.

(21) Appl. No.: 12/719,107

(22) Filed: Mar. 8, 2010

(65) Prior Publication Data

US 2011/0138573 A1 Jun. 16, 2011

(30) Foreign Application Priority Data

Dec. 16, 2009 (CN) ..... 2009 1 0262299

(51) Int. Cl.
*E05F 3/02* (2006.01)

(52) U.S. Cl. ..... 16/66; 16/49; 16/72

(58) Field of Classification Search ..... 16/71, 72, 16/82, 84, 85, 49, 66, 51, DIG. 10
See application file for complete search history.

(56) References Cited

U.S. PATENT DOCUMENTS

| | | | | | |
|---|---|---|---|---|---|
| 2,920,338 | A | * | 1/1960 | Falk | 16/66 |
| 3,072,954 | A | * | 1/1963 | Patriquin | 16/66 |
| 3,090,988 | A | * | 5/1963 | Truhon | 16/66 |
| 3,284,841 | A | * | 11/1966 | Patriquin | 16/66 |
| 3,289,242 | A | * | 12/1966 | Mallory | 16/66 |
| 3,593,367 | A | * | 7/1971 | Waldo | 16/66 |
| 4,139,182 | A | * | 2/1979 | Nagase et al. | 16/51 |
| 4,817,238 | A | * | 4/1989 | Liu | 16/66 |
| 4,894,883 | A | * | 1/1990 | Fleischhauer | 16/66 |
| 5,157,806 | A | * | 10/1992 | Wartian | 16/66 |
| 5,517,719 | A | * | 5/1996 | Christ | 16/49 |
| 5,832,562 | A | | 11/1998 | Luca | |
| 6,317,922 | B1 | * | 11/2001 | Kondratuk | 16/72 |
| 6,976,289 | B1 | * | 12/2005 | Luca | 16/66 |
| 8,051,534 | B1 | * | 11/2011 | Luca | 16/66 |
| 2005/0198773 | A1 | * | 9/2005 | Alonso | 16/49 |
| 2009/0119873 | A1 | * | 5/2009 | Bassi | 16/84 |
| 2009/0300877 | A1 | * | 12/2009 | Wood et al. | 16/71 |
| 2010/0162521 | A1 | * | 7/2010 | Pyo | 16/51 |
| 2010/0287729 | A1 | * | 11/2010 | Jin et al. | 16/72 |

FOREIGN PATENT DOCUMENTS

CN 20072181355.0 8/2008

* cited by examiner

*Primary Examiner* — Jeffrey O Brien

(74) *Attorney, Agent, or Firm* — Schmeiser, Olsen & Watts, LLP

(57) ABSTRACT

The present invention relates to a door closer comprising a cylinder body and a telescopic rod, wherein a one-way air intake valve is provided in the cylinder body to take in air in one way in an internal cavity of the cylinder body when the door is opened. The internal cavity of the cylinder body is divided into two automatically pressurizeable and automatically compensatable air cavities. When the door is opened or closed, the air inside the internal cavity of the cylinder body flows cyclically in the two air cavities. The door closer ensures air substantially flows cyclically in a cylinder body, reduces pollution caused by dusts in air into and out of the cylinder body to the lubricant oil in the cylinder wall, guarantees the lubricating effect of the lubricant oil, enables the door closer to operate normally and effectively prolong the service life of the door closer.

10 Claims, 4 Drawing Sheets

AIR PRESSURE INNER CIRCULATION-TYPE AUTOMATIC COMPENSATION CONTROL DOOR CLOSER

FIELD OF THE INVENTION

The present invention relates to a door closer, and particularly to an air pressure inner circulation-type automatic compensation control door closer.

BACKGROUND OF THE INVENTION

Currently, a door closer is usually mounted between a door body and a doorframe in an office or some public sites. When the door is opened, it will close automatically due to an elastic return force of the door closer, whereby to ensure accurate and timely closing to an initial position after the door is opened and providing great convenience to people's life.

Door closers are roughly classified into hydraulic door closers and air control-type door closers according to the driving sources. Hydraulic door closers have relatively complicated internal structures and therefore are not convenient for spread and application. In the prior art, air control-type door closers are mostly used generally.

In the prior art, some people make specific improvements to the air control-type door closer, e.g., the patent for invention No. 200720181355.0 entitled "Constant Speed Device for Door Closers", wherein the door closer can reduce a return speed of the telescope arm, i.e., lessen the return initial speed of the door body thereby achieving the effect of closing the door at a constant speed in the whole stroke. However, air vents are provided on the wall of the cylinder of the patented invention, air constantly enters from outside. Since air entrains dusts, after a large amount of dusts is mixed to lubricant oil between the cylinder walls, the mixed lubricant oil with dusts are extremely liable to obstructions of through holes of the cylinder wall and deprives the door closer of normal operations. In addition, due to presence of a lot of dusts in the lubricant oil, the lubricating effect of the lubricant oil deteriorates and the lubricating capacity is weakened, the frictional force thereof is increased and the service life of the door closer is shortened.

SUMMARY OF THE INVENTION

An object of the present invention is to overcome drawbacks in the prior art and provide an air pressure inner circulation-type automatic compensation control door closer which ensures air substantially flows cyclically in a cylinder body, reduces pollution caused by dusts in air into and out of the cylinder body to the lubricant oil in the cylinder wall, guarantees the lubricating effect of the lubricant oil, enables the door closer to operate normally and effectively prolong the service life of the door closer.

To achieve the above object, the present invention employs the following technical solution:

An air control-type door closer according to the present invention comprises a cylinder body and a telescopic rod running through an end cap at one end of the cylinder body and being freely telescopic to open and close the door, characterized in that a one-way air intake valve means is provided at the other end of the cylinder body to take in air in one way in an internal cavity of the cylinder body when the door is opened, at one end portion of the telescopic rod in the interior of the cylinder body is connected a regulating valve means wherein the gas in the cylinder body flows cyclically in the cavity of the cylinder body when the telescopic rod in a moving state, an inner cover sealing means is fixedly provided at a position of the cavity of the cylinder body inside the end cap to form gas sealing with the telescopic rod and with an inner wall of the cylinder body, and a large compression spring is provided in a cavity between the inner cover sealing means and the regulating valve means; the internal cavity of the cylinder body is divided into two automatically pressurizeable and automatically compensatable gas cavities through the inner cover sealing means, the regulating valve means and the air intake valve means. When the door is opened or closed, the gas inside the internal cavity of the cylinder body flows cyclically in the two gas cavities.

As a further improvement of the above technology, the inner cover sealing means comprises in turn an inner cover forming sealing with the inner wall of the cylinder body, a sealing block with a slot, and a gasket, which are provided around outside the telescopic rod, the gasket is embedded in the slot of the sealing block, a sealing rubber ring is provided between the inner cover and the sealing block and an inner wall surface of the cylinder body, between the inner side wall of the inner cover and the sealing block and between the sealing block and the telescopic rod.

In the present invention, the regulating valve means comprises a plunger sleeve connected to a free end of the telescopic rod, one end of the plunger sleeve is snap-fitted with the free end of the telescopic rod, the other end of the plunger sleeve is provided with an opening inside which a valve jacket and a first valve core are provided in turn from outside to inside, a central through hole is provided in the interior of the valve jacket and the first valve core, the first valve core is disposed in the central hole at a distal position of the valve jacket and cooperates sealingly with the valve jacket, a first head pin is provided in the central through hole of the first valve core to cooperate sealingly with the inner wall surface of the first valve core, a small compression spring is provided between a bottom portion of the first head pin and a bottom portion of the central through hole at a head position of the valve jacket, a plurality of air vents are provided symmetrically on the plunger sleeve, and an air flow channel for air circulation purpose is provided on the outer wall surface of the valve jacket.

To perform a speed regulating function of the door closer of the present invention, the plunger sleeve is threadedly connected to an end portion of the valve jacket, and an air gap for receiving air is provided between an internal cavity of the plunger sleeve and a middle position of the valve jacket. The size of the air gap receiving air can be changed by tightly screwing the valve jacket or screwing out the plunger sleeve to change a flow speed of the air flow, thereby achieving the object of better regulating the door closing speed of the door closer.

In order to improve the sealing performance of the present invention, a sealing rubber ring is provided respectively between the outer wall of the end portion of the plunger sleeve and the inner wall of the cylinder body, between the first valve core and an inner wall of the valve jacket, and on the outer wall of the valve jacket.

In the present invention, an annular slot is provided at a distal end portion of the telescopic rod, a boss is provided on the plunger sleeve, and the telescopic rod is snap fitted with the plunger sleeve via the annular slot and the boss so that the telescopic rod, upon rotation, cannot bring all the parts in the cylinder body 1 of the door closer into rotation so as to ensure a stable working performance of the door closer.

As a further improvement of the above technology, the one-way air intake valve means comprises a rotatable handwheel, a central through hole with stepped faces is provided in the rotatable handwheel, a second valve core in sealing cooperation with the rotatable handwheel is provided in the central through hole in the head portion of the rotatable handwheel, a central hole is also provided in the interior of the second valve core in which is disposed a head pin sealingly cooperating with the second valve core, a small compression spring is provided between a bottom portion of the head pin and a distal end stepped face of the central through hole of the rotatable handwheel, the dimension of the distal end of the rotatable handwheel cooperates with the dimension of the central hole of the valve jacket in the regulating valve means.

In the present invention, in order to better limit the end portion of the large compression spring, a spring clip for clipping the large compression spring is provided on the inner wall of the cylinder body at the same side of the one-way air intake valve means.

In the present invention, the central hole of the end portion of the valve jacket is a hexagonal or square hole; when the door is completely closed, the door closing speed can be effectively regulated, i.e., the valve jacket can be strewed into or out of the plunger sleeve by complete cooperation between the central hole of the end portion of the valve jacket and the rotatable handwheel and by rotating the valve jacket via the rotatable handwheel to better satisfy the user's needs.

Additionally, for easy replacement of the parts in the interior of the cylinder body, the end cap is snap-fitted with the open end of the cylinder body. In the event of maintenance or replacement, the end cap only needs to be opened, which is convenient and practical.

As compared with the prior art, the advantageous effects of the present invention are as follows:

(1) The door closer according to the present invention is an air pressure inner circulation-type automatic compensation door closer, wherein by means of the one-way air intake valve means, the regulating valve means and the inner cover sealing means provided at the internal cavity at the other end of the cylinder body, when the telescopic rod gradually extends when the door is opened, the cavity between the regulating valve means and the one-way air intake means forms a negative pressure, whereupon air between the inner cover sealing means and the regulating valve means flows into the cavity between the one-way air intake valve means and the regulating valve means, and when necessary, the one-way air intake valve means opens to complement air to the internal cavity of the cylinder body (air is sucked in chiefly by the one-way air intake valve means at the first time of use). When the door closes automatically, the telescopic rod retracts due to an elastic return force of the large compression spring, the cavity between the inner cover sealing means and the regulating valve means forms a negative pressure, whereupon the one-way air intake valve means is in a gas sealing state and does not release air outside, air between the regulating valve means and the one-way air intake valve means enters the cavity between the inner cover sealing means and the regulating valve means through the regulating valve means, and the gas in the cylinder still merely flows cyclically in the interior of the cylinder body. The two gas cavities in the cylinder body can pressurize automatically and compensate automatically, so that the gas in the cylinder body will not leak outside but flows cyclically in the interior of the cylinder body even if the door is opened and closed for many times, thereby avoiding pollution of the lubricant oil on the inner wall of the cylinder body caused by external air into and out of the cylinder body for many times and influence on normal use and service life of the door closer; a larger amount of compressed air between the one-way air intake valve means and the regulating valve means provides a greater resistance against the restoration of the telescopic rod so that the telescopic rod exhibits a good damping effect upon retraction and return, better ensures no greater impingement and small noise when the door body is closed, and protect the door body or doorframe from damages, with a great practicability.

(2) According to the present invention, the movement speed of the telescopic rod of the door closer can be regulated according to the user's own needs, thereby regulating the door closing speed of the door closer and providing convenience and practicability.

BRIEF DESCRIPTION OF THE ACCOMPANYING DRAWINGS

The present invention will be described in detail with reference to the drawings and preferred embodiments.

DETAILED DESCRIPTION OF PREFERRED EMBODIMENTS

Figure 1:
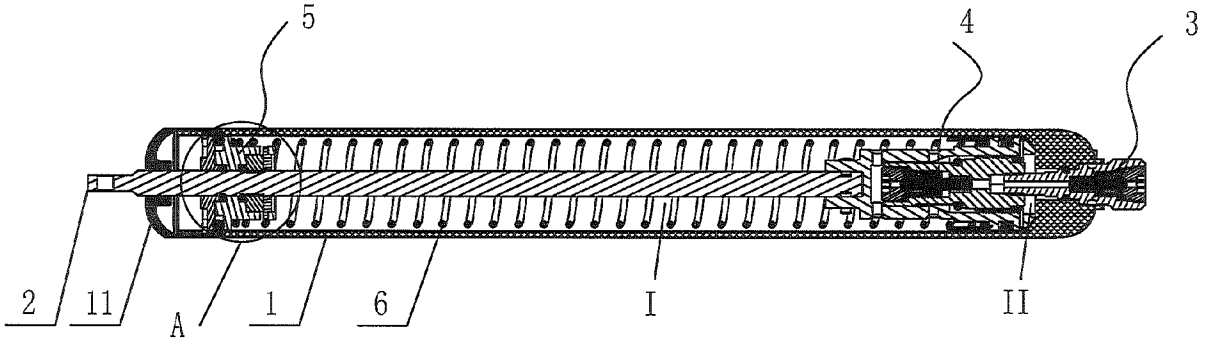
FIG. 1 is a schematic view of a door closer in a stop state after the door is closed according to the present invention.
Figure 3:
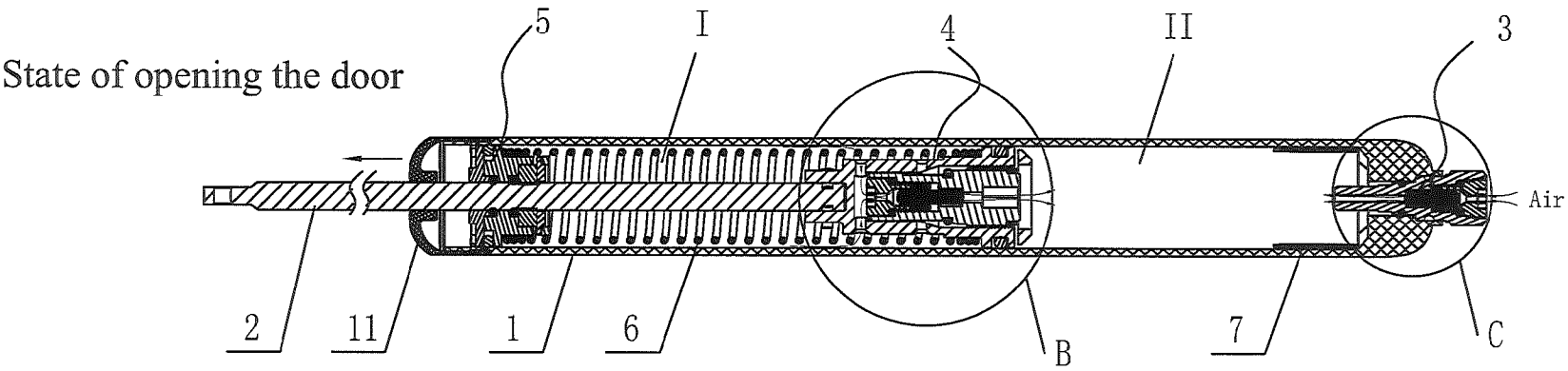
FIG. 3 is a schematic view showing a state of the door closer during opening of the door according to the present invention.
Figure 6:
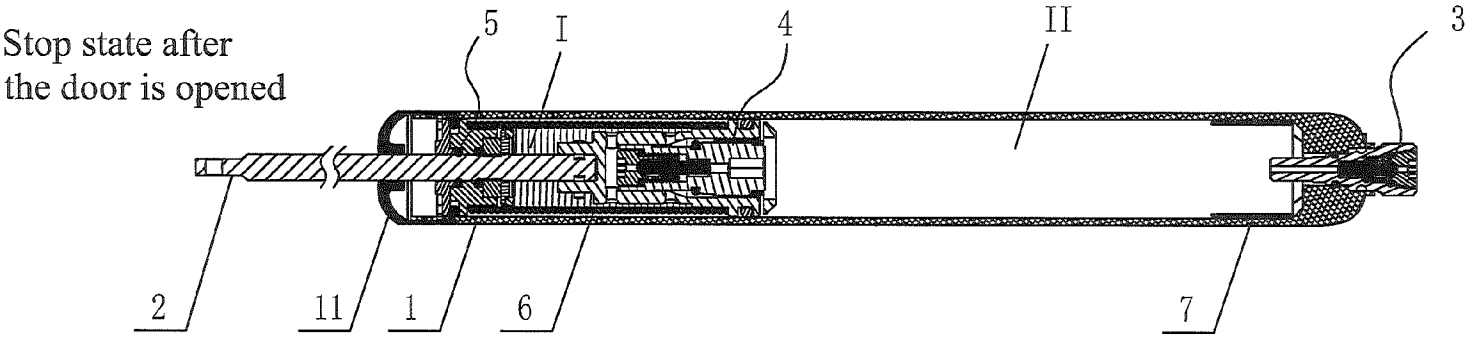
FIG. 6 is a schematic view showing the door closer in a stop state after the door is opened according to the present invention.
Figure 7:
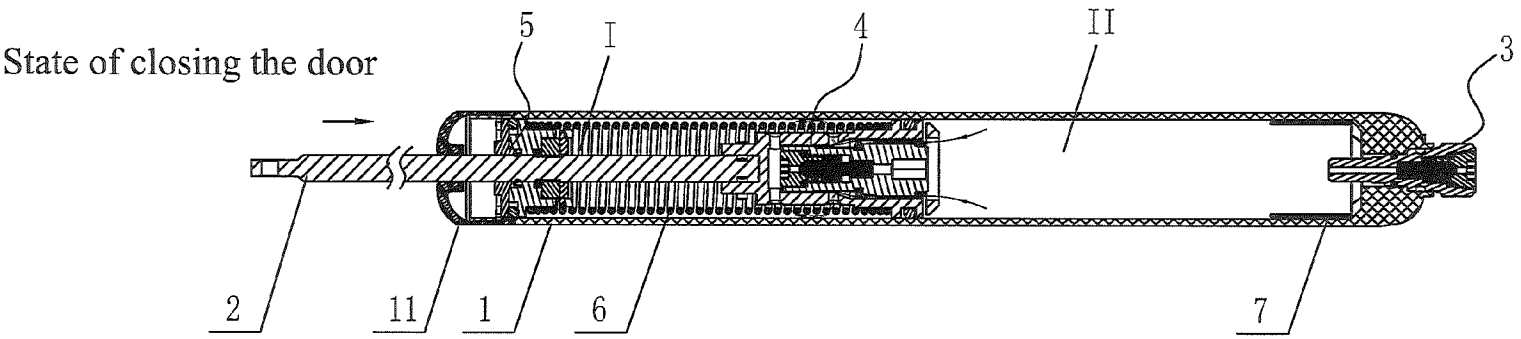
FIG. 7 is a schematic view showing a state of the door closer during closing of the door according to the present invention.

As shown in FIG. 1, an air pressure inner circulation-type automatic compensation control door closer according to the present invention comprises a cylinder body 1 and a telescopic rod 2 running through an end cap of the cylinder body 1 and being freely telescopic to open and close the door, wherein a one-way air intake valve means 3 is provided at the other end of the cylinder body 1 to take in air in one way in an internal cavity of the cylinder body 1 when the door is opened, at one end portion of the telescopic rod 2 in the interior of the cylinder body 1 is connected a regulating valve means 4 which correspondingly cooperates with the one-way air intake valve means 3 to realize gas sealing when the door body is in a closed state, and allows the gas in the cylinder body 1 to flow in the cavity of the cylinder body 1 when the door is opened, an inner cover sealing means 5 is fixedly provided at a position of the cavity of the cylinder body 1 inside the end cap 11 to form gas sealing with the telescopic rod 2 and with an inner wall of the cylinder body 1, and a large compression spring 6 is provided in a cavity between the inner cover sealing means 5 and the regulating valve means 4; when the door is opened, the internal cavity of the cylinder body 1 is divided into two gas cavities, namely, a front zone I and a rear zone II as shown in FIGS. 3, 6 and 7, through the inner cover sealing means 5, the regulating valve means 4 and the air intake valve means.

Figure 2:
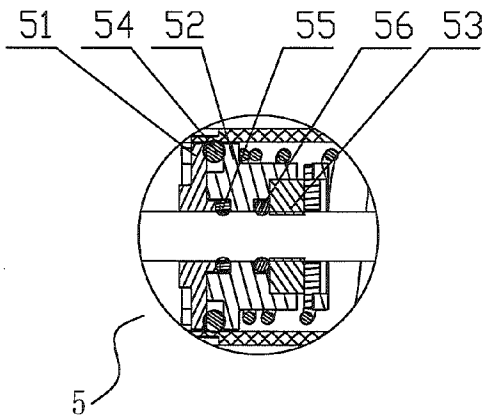
FIG. 2 is an enlarged view of location A in FIG. 1.

As can be seen from FIGS. 1 and 2, the inner cover sealing means 5 comprises in turn an inner cover 51 forming sealing with the inner wall of the cylinder body 1, a sealing block 52 with a slot, and a gasket 53, which are provided around outside the telescopic rod 2, the gasket 53 is embedded in the slot of the sealing block 52, a sealing rubber ring 54 is provided between the inner cover 51 and the sealing block 52 and an inner wall surface of the cylinder body 1, a sealing rubber ring 55, 56 is provided between the inner side wall of the inner cover 51 and the sealing block and between the sealing block 52 and the telescopic rod 2. Besides, one end of the large compression spring 6 abuts against one end portion of the sealing block 52.

Figure 4:
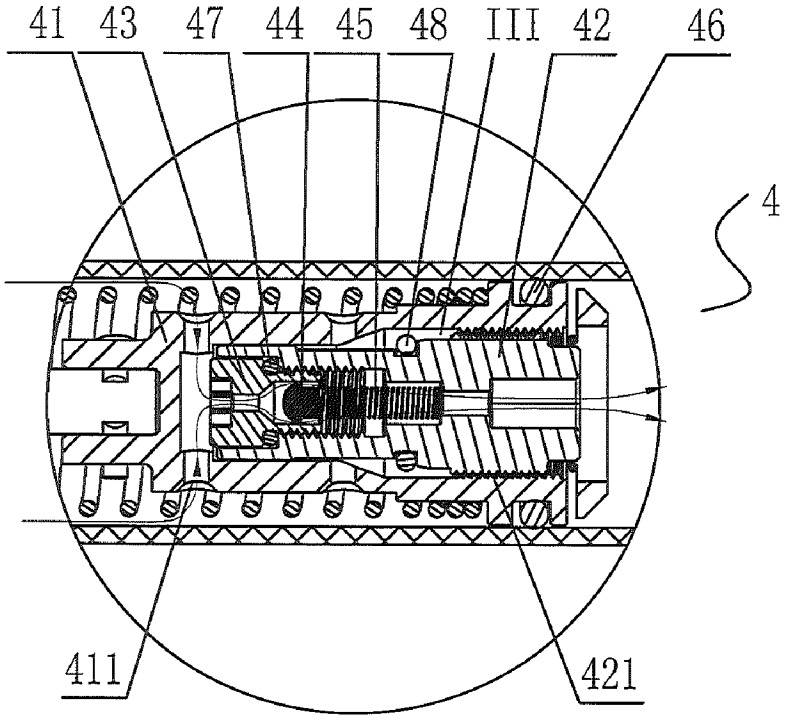
FIG. 4 is an enlarged view of location B of FIG. 2.

In the present invention, as shown in FIG. 3 and FIG. 4, the regulating valve means 4 comprises a plunger sleeve 41 connected to a free end of the telescopic rod 2, one end of the plunger sleeve 41 is snap-fitted with the free end of the telescopic rod 2, the other end of the plunger sleeve 41 is provided with an opening inside which a valve jacket 42 and a first valve core 43 are provided in turn from outside to inside, a central through hole is provided in the interior of the valve jacket 42 and the first valve core 43, the first valve core 43 is disposed in the central hole at a distal position of the valve jacket 42 and cooperates sealingly with the valve jacket 42, a first head pin 44 is provided in the central through hole of the first valve core 43 to cooperate sealingly with an end head portion of the inner wall surface of the first valve core 43, a small compression spring 45 is provided between a bottom portion of the first head pin 44 and a bottom portion of the central through hole at a head position of the valve jacket 42, a plurality of air vents 411 are provided symmetrically on the plunger sleeve 41, and an air flow channel 421 for air circulation purpose is provided on the outer wall surface of the valve jacket 42.

In addition, as shown in FIG. 4, the plunger sleeve 41 is threadedly connected to an end portion of the valve jacket 42, and an air gap III for receiving air is provided between an internal cavity of the plunger sleeve 41 and a middle position of the valve jacket 42. The size of the air gap receiving air can be changed real time, i.e., the speed of air flow from the front zone I to the rear zone II can be changed, by tightly screwing the valve jacket 42 or screwing out the plunger sleeve 41.

To improve the sealing effect, a sealing rubber ring 46 is provided at an end portion of the plunger sleeve 41, a sealing rubber ring 47 is provided between the first valve core 43 and an inner wall of the valve jacket 42, and a sealing rubber ring 48 is provided on the outer wall of the valve jacket 42.

In the present invention, an annular slot is provided at a distal end portion of the telescopic rod 2, a boss is provided on the plunger sleeve 41, and the telescopic rod 2 is snap fitted with the plunger sleeve 41 via the annular slot and the boss so that the telescopic rod 2, upon rotation, cannot bring all the parts in the cylinder body 1 of the door closer into rotation so as to ensure a stable working performance of the door closer.

Figure 5:
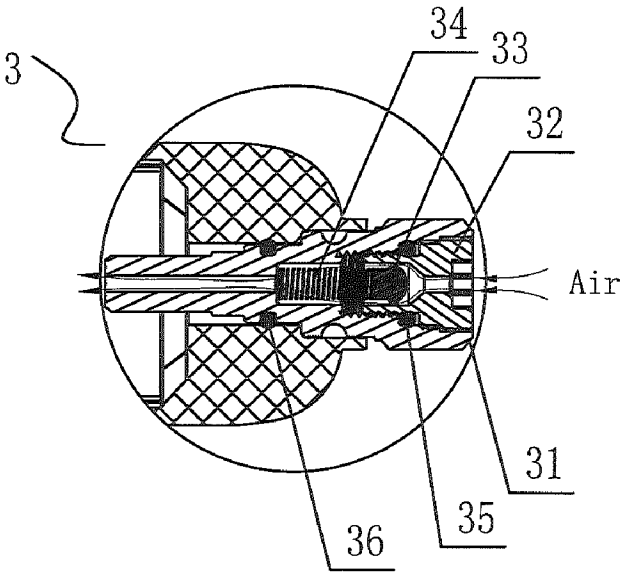
FIG. 5 is an enlarged view of location C of FIG. 2.

In the present invention, as shown in FIGS. 3 and 5, the one-way air intake valve means 3 comprises a rotatable handwheel 31, a central through hole with stepped faces is provided in the rotatable handwheel 31, a second valve core 32 in sealing cooperation with the rotatable handwheel 31 is provided in the central through hole in the head portion of the rotatable handwheel 31, a central hole is also provided in the interior of the second valve core 32 in which is disposed a second head pin 33 sealingly cooperating with the second valve core 32, a small compression spring 34 is provided between a bottom portion of the second head pin 33 and a distal end stepped face of the central through hole of the rotatable handwheel 31, the dimension of the distal end of the rotatable handwheel 31 corresponds to and cooperates with the dimension of the central hole of the valve jacket 42 in the regulating valve means 4, the central hole of the end portion of the valve jacket 42 is a hexagonal or square hole; when the door is completely closed, the door closing speed can be effectively regulated by complete cooperation between the central hole of the end portion of the valve jacket 42 and the rotatable handwheel and by rotating the valve jacket 42 via the rotatable handwheel 31, to better satisfy a client's needs. In addition, to guarantee the gas sealing performance of the one-way air intake valve means 3, a sealing rubber ring 35 is mounted between the rotatable handwheel 31 and the second valve core 32, and a sealing rubber ring 36 is provided between the rotatable handwheel 31 and an inner wall of the cavity at the opening end portion of the cylinder body 1, so that, when the door is opened, gas can enter the cylinder body 1 through the central through hole of the rotatable handwheel 31 to complement gas to the cylinder body 1, and when the door is closed, a better gas sealing performance is achieved to ensure an excellent use performance of the door closer.

As shown in FIGS. 1, 3, 6 and 7, a spring clip 7 for clipping the large compression spring 6 is provided on the inner wall of the cylinder body 1 at the same side of the one-way air intake valve means 3.

In the present invention, the end cap 11 is snap-fitted with or can be detachably mounted with the open end of the cylinder body 1, thereby facilitating replacement or maintenance and cleaning of the internal parts of the cylinder body 1.

The working procedure of the pneumatic control-type door closure of the present invention is as follows:

FIG. 1 is a schematic view of the door closer in a stop state after the door is closed, whereupon the telescopic rod 2 retracts to a maximum extent into the interior of the cylinder body 1, the one-way air intake valve means 3 closely cooperates with the regulating valve means 4 so that the regulating valve means 4 divides the internal cavity of the cylinder body 1 into a front zone I and a rear zone II, wherein the compressed air in the rear zone II flows towards the front zone through the air vents 411 of the plunger sleeve 41 and the air flow channel 421 of the valve jacket 42, the front zone I forms an air compression zone with an maximum air amount under a tension of the sealing rubber ring of the plunger sleeve and the sealing rubber rings 54, 55, 56 of the inner cover sealing means 5, and the rear zone II forms a negative pressure vacuum zone. At this time, the door closing speed can be regulated by turning a regulating handle of the rotatable handwheel 31. Generally, when the regulating handle is rotated in a clockwise direction, the door closing speed is reduced; when the regulating handle is rotated in a counter-clockwise direction, the door closing speed is increased. The speed can be regulated as per the user's own needs for convenient use.

FIG. 3 shows a schematic view showing a state of the door closer during opening of the door. When the door is opened, the telescopic rod 2 brings the regulating valve means 4 to move forwards the front zone, whereupon while the telescopic rod 2 gradually extends, air is supplemented to the internal cavity of the cylinder body 1 from the one-way air intake valve means 3, the compressed air in the front zone I between the inner cover sealing means 5 and the regulating valve means 4 flows into a rear zone air cavity between the one-way air intake valve means 3 and the regulating valve means 4 so that the amount of the compressed air in the rear zone II gradually increases. When the door is opened to a maximum extent of 90 degrees, as shown in FIG. 6, the large compression spring 6 is compressed to a maximum deformation amount, the door is opened to the maximum extent and the compressed air in the rear zone II air cavity reaches a maximum amount.

As shown in FIG. 7, the door closes automatically, the telescopic rod 2 retracts due to an elastic return force of the large compression spring 6, the one-way air intake valve means 3 is in a gas sealed state and will not release the compressed air in the rear zone II and substantially maintains the air amount in the cylinder body 1 to enable the gas in the cylinder body 1 to be used cyclically. When the telescopic rod 2 returns slowly due to the return force of the large compression spring 6, the compressed air in the rear zone II flows towards the front zone I through the air flow channel 421 of the valve jacket 42, the air vent 411 of the plunger sleeve 41 and the air gap III. Since the compressed air in the rear zone II flows slowly into the front zone I, the telescopic rod 2 returns at a low speed upon returning and exhibits a better damping effect, thereby avoiding hurt of any person due to a sudden shut, reduce the door closing noise, preventing possible damages to the door body and the door frame due to great impingement of the door body when closed to the door frame, and ensuring the service life of the door.

The door closer according to the present invention is adapted for a door body of any structure, mounted in a currently common mounting manner, generally mounted on a doorhead position in a way that a fixing end of the telescopic rod 2 is mounted on a top position of the door body and one end portion of the cylinder body 1 is mounted on the doorframe or between the doorframe.

The present invention is not limited to the above embodiments. If various modifications or variations to the present invention do not depart from the spirit and scope of the present invention and fall within the scope of claims of the present invention and equivalent technologies, the present invention also contains these modifications and variations.

What is claimed is:

1. An air pressure inner circulation automatic compensation control door closer, comprising a cylinder body and a telescopic rod running through an end cap at a first end of the cylinder body and being freely telescopic to open and close the door, characterized in that a one-way air intake valve means is provided at a second end of the cylinder body to take in air in one way in an internal cavity of the cylinder body when the door is opened, at one end portion of the telescopic rod in the interior of the cylinder body is connected a regulating valve means wherein the air in the cylinder body flows cyclically in the cavity of the cylinder body when the telescopic rod is in a moving state, an inner cover sealing means is fixedly provided at a position of the cavity of the cylinder body inside the end cap to form air sealing with the telescopic rod and with an inner wall of the cylinder body, and a large compression spring is provided in the cavity between the inner cover sealing means and the regulating valve means; the internal cavity of the cylinder body is divided into two automatically pressurizeable and automatically compensatable air cavities through the inner cover sealing means, the regulating valve means and the air intake valve means; when the door is opened or closed, the air inside the internal cavity of the cylinder body flows cyclically in the two air cavities.

2. The air pressure inner circulation automatic compensation control door closer according to claim 1, characterized in that: the inner cover sealing means comprises in turn an inner cover forming sealing with the inner wall of the cylinder body, a sealing block with a slot, and a gasket, which are provided around the telescopic rod, the gasket is embedded in the slot of the sealing block, a sealing rubber ring is provided between the inner cover, the sealing block, and an inner wall surface of the cylinder body, between an inner side wall of the inner cover and the sealing block and between the sealing block and the telescopic rod.

3. The air pressure inner circulation automatic compensation control door closer according to claim 2, characterized in that: the regulating valve means comprises a plunger sleeve connected to a free end of the telescopic rod, one end of the plunger sleeve is snap-fitted with the free end of the telescopic rod, an opposite end of the plunger sleeve is provided with an opening inside which a valve jacket and a first valve core are provided in turn from outside to inside, a central through hole is provided in the interior of the valve jacket and the first valve core, the first valve core is disposed in the central hole at a distal position of the valve jacket and cooperates sealingly with the valve jacket, a first head pin is provided in the central through hole of the first valve core to cooperate sealingly with an inner wall surface of the first valve core, a small compression spring is provided between a bottom portion of the first head pin and a bottom portion of the central through hole at a head position of the valve jacket, a plurality of air vents are provided symmetrically on the plunger sleeve, and an air flow channel for air circulation purpose is provided on an outer wall surface of the valve jacket.

4. The air pressure inner circulation automatic compensation control door closer according to claim 3, characterized in that: the plunger sleeve is threadedly connected to an end portion of the valve jacket, and an air gap for receiving air is provided between an internal cavity of the plunger sleeve and a middle position of the valve jacket.

5. The air pressure inner circulation automatic compensation control door closer according to claim 4, characterized in that: a plurality of sealing rubber rings are provided respectively between an outer wall of an end portion of the plunger sleeve and the inner wall of the cylinder body, between the first valve core and an inner wall of the valve jacket, and on the outer wall of the valve jacket.

6. The air pressure inner circulation automatic compensation control door closer according to claim 5, characterized in that: an annular slot is provided at a distal end portion of the telescopic rod, a boss is provided on the plunger sleeve, and the telescopic rod is snap fitted with the plunger sleeve via the annular slot and the boss.

7. The air pressure inner circulation automatic compensation control door closer according to claim 6, characterized in that: the one-way air intake valve means comprises a rotatable handwheel, a central through hole with stepped faces is provided in the rotatable handwheel, a second valve core in sealing cooperation with the rotatable handwheel is provided in the central through hole in the head portion of the rotatable handwheel, a central hole is also provided in an interior of the second valve core in which is disposed a second head pin sealingly cooperating with the second valve core, a small compression spring is provided between a bottom portion of the second head pin and a distal end stepped face of the central through hole of the rotatable handwheel, and the dimension of the distal end of the rotatable handwheel cooperates with the dimension of the central hole of the valve jacket in the regulating valve means.

8. The air pressure inner circulation automatic compensation control door closer according to claim 7, characterized in that: a spring clip for clipping the large compression spring is provided on the inner wall of the cylinder body at the same side as the one-way air intake valve means.

9. The air pressure inner circulation automatic compensation control door closer according to claim 8, characterized in that: the central hole of the end portion of the valve jacket is a hexagonal or square hole.

10. The air pressure inner circulation automatic compensation control door closer according to claim 1, characterized in that: the end cap is snap-fitted with an open end of the cylinder body.

* * * * *